US008000958B2

(12) United States Patent
Gregory, Jr. et al.

(10) Patent No.: US 8,000,958 B2
(45) Date of Patent: Aug. 16, 2011

(54) DEVICE AND METHOD FOR IMPROVING COMMUNICATION THROUGH DICHOTIC INPUT OF A SPEECH SIGNAL

(75) Inventors: Stanford W. Gregory, Jr., Streetsboro, OH (US); Will Kalkhoft, Canton, OH (US)

(73) Assignee: Kent State University, Kent, OH (US)

( * ) Notice: Subject to any disclaimer, the term of this patent is extended or adjusted under 35 U.S.C. 154(b) by 1128 days.

(21) Appl. No.: 11/803,315

(22) Filed: May 14, 2007

(65) Prior Publication Data

US 2010/0262422 A1 Oct. 14, 2010

Related U.S. Application Data

(60) Provisional application No. 60/800,882, filed on May 15, 2006.

(51) Int. Cl.
*G10L 19/14* (2006.01)

(52) U.S. Cl. ..... 704/205; 704/207; 704/210; 704/215; 704/226; 463/35; 455/306; 455/309

(58) Field of Classification Search ..... 704/205, 704/207, 210, 215, 231, 226–228; 381/110, 381/98, 99, 23.1, 104; 463/35; 455/306, 455/339

See application file for complete search history.

(56) References Cited

U.S. PATENT DOCUMENTS

| | | | | |
|---|---|---|---|---|
| 3,894,196 | A | 7/1975 | Briskey | |
| 4,256,547 | A * | 3/1981 | Turns et al. | 205/203 |
| 4,472,603 | A * | 9/1984 | Berg | 381/324 |
| 4,488,007 | A * | 12/1984 | Chataignon et al. | 379/395 |
| 5,573,403 | A | 11/1996 | Beller et al. | |
| 5,692,059 | A * | 11/1997 | Kruger | 381/151 |
| 5,873,059 | A * | 2/1999 | Iijima et al. | 704/207 |
| 5,933,803 | A * | 8/1999 | Ojala | 704/223 |
| 6,122,611 | A * | 9/2000 | Su et al. | 704/228 |
| 6,453,283 | B1 * | 9/2002 | Gigi | 704/207 |
| 6,956,955 | B1 * | 10/2005 | Brungart | 381/310 |

(Continued)

FOREIGN PATENT DOCUMENTS

FR 2642557 8/1990

*Primary Examiner* — Vijay Chawan
(74) *Attorney, Agent, or Firm* — Hudak, Shunk & Farine Co. LPA

(57) ABSTRACT

The device and method of the present invention improves electronic communication which have behavioral consequences, including for example, flight communication, two-way closed circuit communication such as for fire, police, miners, scuba divers and other heath and safety workers, and even for mobile communication which happens during activities such as cellular or mobile conversations during driving. Dichotic listening techniques are altered to enhance dyadic (involving two people) interactions with a partner. The speech of at least the first member of the dyad is filtered to isolate the component below 0.5 Khz, which will be input with a gain to the left ear of the second person (provided that they are right-handed), and thus their right cerebral hemispheres, and the component with a frequency above 0.5 Khz. will be input to their right ears, and thus their left cerebral hemispheres. The apparatus of the invention includes a communication source, which could include live and simultaneous broadcast, or pre-recorded communication. This constitutes the communication input which is directed to a filter to split off the speech fundamental frequency, i.e. the SFF. The post filtered communication signal, or "SFF augmented signal" is fed to a differentiation device which differentiates two signals, one with an enhanced SFF, and one without the enhancement subsequently, a delivery device delivers the now differentiated left and right signals to the appropriate ears.

34 Claims, 5 Drawing Sheets

U.S. PATENT DOCUMENTS 7,310,558 B2 * 12/2007 Van Hoesel ..... 607/57
7,505,601 B1 * 3/2009 Brungart ..... 381/309
2003/0129956 A1 * 7/2003 Virolainen ..... 455/306
2005/0190925 A1 * 9/2005 Miura et al. ..... 381/17
2009/0304203 A1 * 12/2009 Haykin et al. ..... 381/94.1
2010/0262422 A1 * 10/2010 Gregory et al. ..... 704/205

* cited by examiner

DEVICE AND METHOD FOR IMPROVING COMMUNICATION THROUGH DICHOTIC INPUT OF A SPEECH SIGNAL

This application is based on U.S. Provisional Application Ser. No. 60/800,882 filed on May 15, 2006

The present invention relates to a device and to a method for improving communication through enhanced dichotic listening. In particular, the device and method of the present invention relate to improvements in electronic communication which have behavioral consequences, including for example, flight communication, two-way closed circuit communication such as for fire, police, miners, scuba divers, health and safety workers, and even for mobile communication which happens during activities such as cellular or mobile conversations during driving.

BACKGROUND OF THE INVENTION

In the nineteenth century, Paul Broca established the cerebral location for articulate speech as residing in the left cerebral hemisphere. Since Broca's discovery, subsequent studies by investigators in a multitude of scientific disciplines have localized additional components of human language in areas of left hemisphere as well as the right. In this connection, psychologists and brain physiologists have developed an important literature on brain lateralization that localizes behavioral and cognitive functions to specific areas of the brain and because specific behavioral and perceptual attributes have been localized in the brain, they have thus been related to proximate cognitive functions about which there is more extended knowledge. However, there is still controversy over strict locationist models pertaining to language and speech, as human communication is not restricted to the verbal message alone but an array of nonverbal vocal communication forms as well. These forms have not, as yet, been designated as left or right cerebral functions.

Human vocal communication is a multiplex signal comprised of verbal and paraverbal components. The paraverbal component of speech transmits a frequency signal that is independent of the more conventionally known verbal signal, and specifically below 0.5 Khz in the speech spectrum. This has been referred to in the literature as the speaking fundamental frequency or "SFF" and has been shown in research to be the spectral carrier of a communication function that is manipulated by interacting speakers to produce social convergence and social status accommodation. Social status accommodation between interacting partners has been found to provide a means whereby persons can mutually adapt their lower voice frequencies to produce an elemental form of social convergence. This convergence is then used to complete social tasks by preparing the communication context for transmission of verbal information contained in the frequencies above 0.5 Khz. Research involving filtering of the SFF band in dyadic task related conversations has shown that the lower frequency is critically important in human communication and may play an independent role tantamount with its verbal counterpart.

Past research into tracing or mapping the cerebral location of behavioral functions has involved various invasive and direct, as well as passive and active techniques. One researcher, Kimura, used dichotic listening techniques in the early 1970's to monitor the symmetry of identification of words presented to a subject's right ear or left ear respectively. The dichotic listening technique involves the simultaneous input of stimuli to each ear but with a different stimulus to each ear. Rather surprisingly, Kimura found that the right ear appeared to have an advantage in the subjects' reporting right ear stimuli more accurately. Kimura reasoned that her finding could relate to earlier findings in animal studies by Rosenzweig that contralateral (opposite sided) transmissions from ear to brain (i.e. from one ear to the opposite brain hemisphere) are stronger than ipsilateral transmissions (i.e. from an ear to the same side brain hemisphere).

SUMMARY OF THE INVENTION

The present invention relates to a device and to a method in which the conventionally known dichotic listening techniques are altered to enhance dyadic (involving two people) interactions with a partner. Specifically, the speech of at least the first member of the dyad is filtered to isolate a first speech component which is below the defining frequency, specifically about 0.75 Khz, and preferably below about 0.5 Khz, and most preferably below about 0.35 Khz, which will be input with at least about a 5 db, and preferably at least about a 10 db gain, and most preferably at least about a 12 db. gain to one ear which accesses the dominant cerebral hemisphere (i.e. in most right handers, the left ear and the right cerebral hemispheres). A second speech component which includes the speech with a frequency above the defining frequency, such as about 0.75 Khz, and preferably above about 0.5 Khz., and most preferably above about 0.35 Khz will be input to other ear, and thus the other cerebral hemisphere. The second component may include the entire speech spectrum or may comprise the isolated portion which is not the "SFF", i.e., the speaking fundamental frequency. In this manner the speech signal will be distributed dichotically to the appropriate hemispheres in order to generate the most efficacious cognitive processing. This dichotic processing eliminates the need for the brain to expend time and energy in appropriately routing its messages, thereby lessening possible problems with cognitive overload and leading to a more timely and accurate communication transmission.

The invention further relates to an apparatus for the enhancement of electronic communication; in particular it relates to electronic communication which uses ear phones or other similar means to deliver the sound individually to the right and left ear of a listener. The invention further relates to a method of improving the efficiency and accuracy of remotely directed tasks which could involve areas as diverse as driving or delivery tasks and other logistical or traffic control applications including commercial and military ground and air traffic control; public and safety regulation including police, military, fire health and emergency communication networks; and even entertainment enhancement including high end amusement rides and other virtual communication experiences.

The apparatus of the invention includes a communication source, which could include live and simultaneous broadcast, or pre-recorded communication. This constitutes the communication input which is directed to a filter to split off the speech fundamental frequency, i.e. the SFF. The post filtered communication signal, or "SFF augmented signal" is fed to a differentiation device which differentiates two signals, one with an enhanced SFF, and one without the enhancement subsequently, a delivery device delivers the now differentiated left and right signals to the appropriate ears. While the invention has been shown to have some effect simply by differentiating the SFF signal fed to the left and the right ears, it is preferable that the SFF enhanced signal is fed to the left ear, and ultimately to the right cerebral hemisphere.

The apparatus could consist of a filter which is incorporated in a cell phone, or in a headset, or earphones which are used with cell phones which simply filter and enhance the portion of the frequency below 0.5 KHz which is then sent to the user's left ear. Similarly, for flight traffic control or military command communication, a headset or helmet could be fitted with the SFF filter and enhancement for augmenting the left ear signal. This device could also be useful for other health and safety closed communication, such as is used by fire fighters, police and other emergency workers. It is also possible that the invention could be useful to provide in the entertainment venue, such as to provide for more realistic virtual reality experience in video games or high end amusement rides.

The invention further relates to a method for improvement in the efficiency and accuracy of remotely directed behavioral based tasks. In particular, this would include flight traffic control, strategic military command, including recognizance and ballistics, logistics and delivery, and other ground civil ground transportation modalities, such as trucking, and taxi services.

DETAILED DESCRIPTION OF THE DRAWINGS

Figure 1:
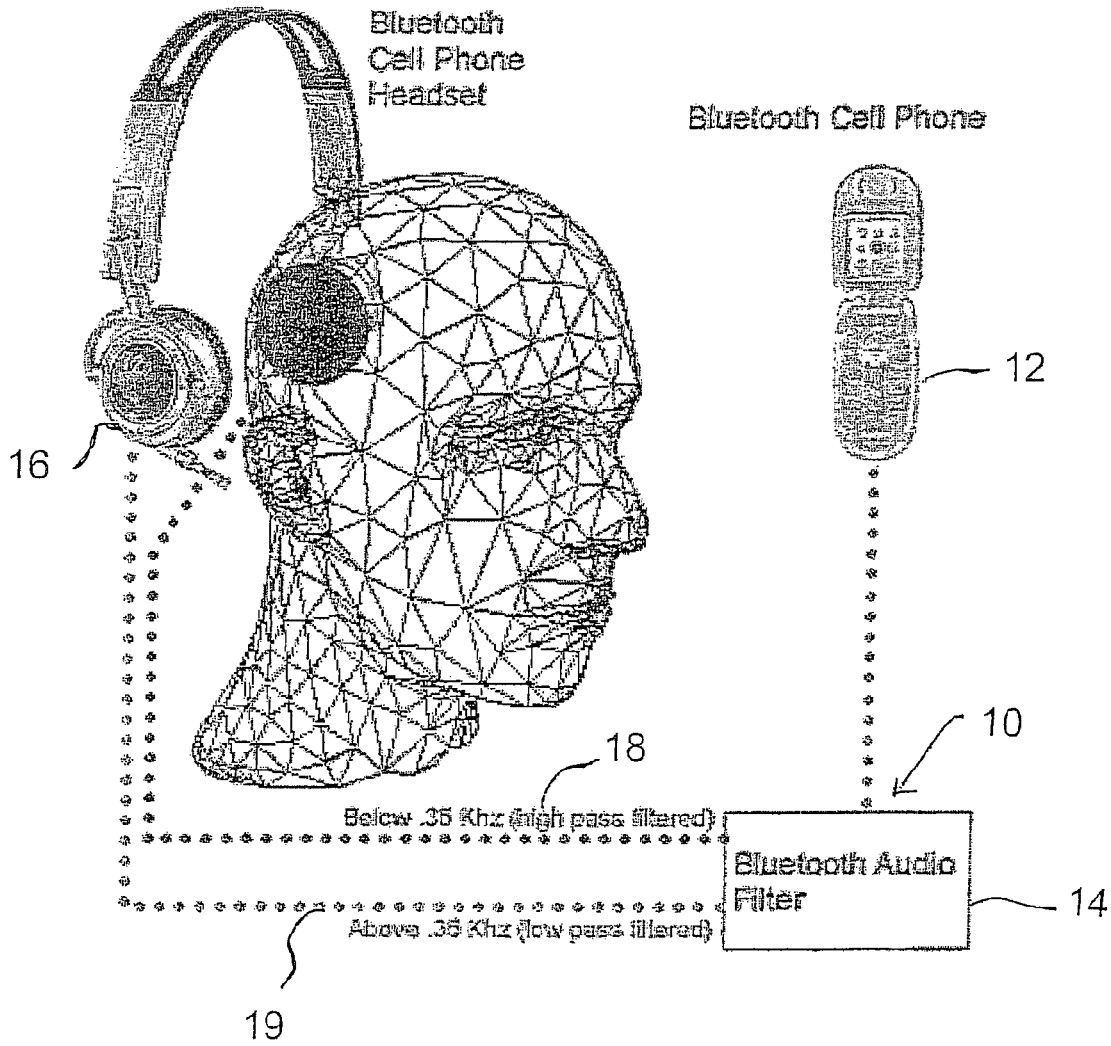
FIG. 1 is a schematic diagram which represents a device in accordance with the present invention.
Figure 2:
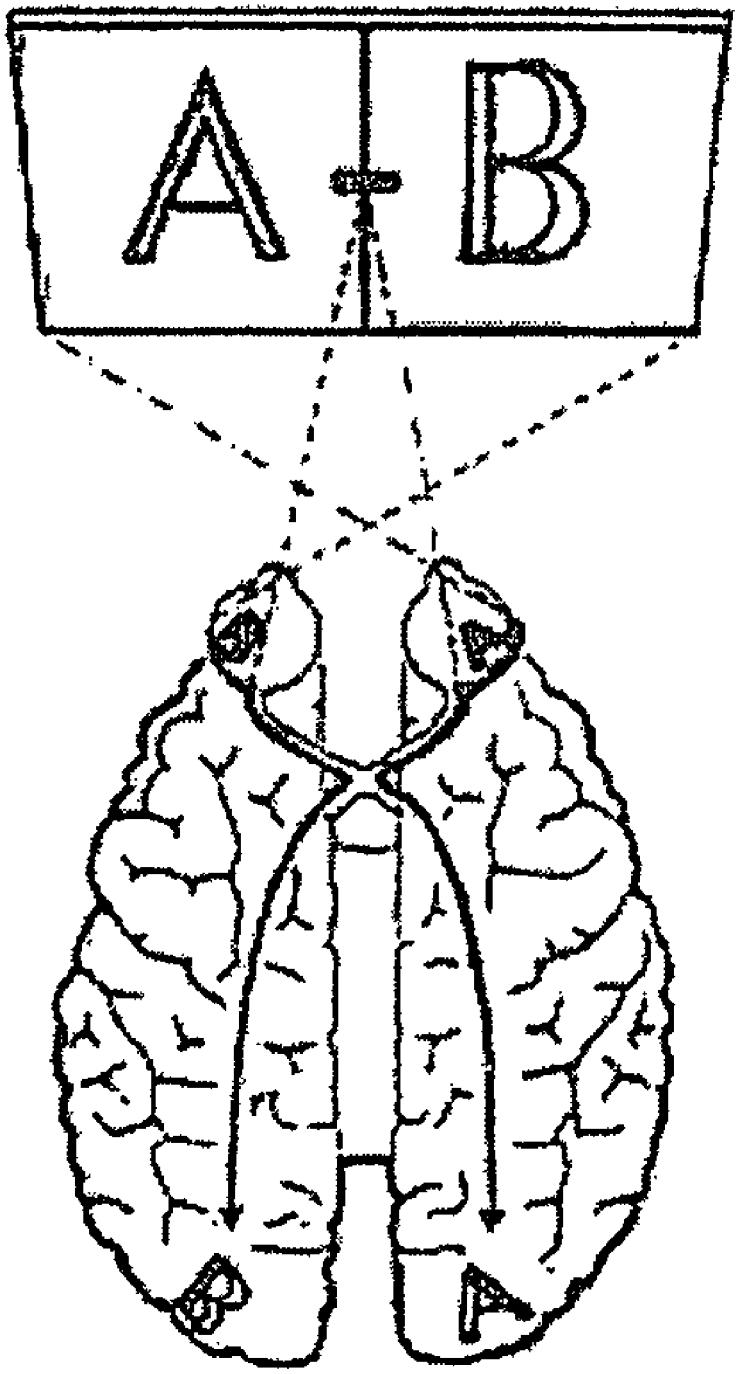
FIG. 2 is a schematic diagram which illustrates the visual pathways to the hemispheres.

FIG. 1 illustrates a device 10 in accordance with the invention and specifically includes a source 12 which transmits the vocalizations of a first person to a second person who is engaged in a task. The device also includes an audio filter 14 which defines a first and a second speech component. In this case, the source is a cell phone which feeds the transmission through a filter to filter the speech component to a first component which is the speaking fundamental frequency, and is below about 0.75 Khz, preferably below about 0.5 Khz, and most preferably below about 0.35 Khz. This first speech component is directed to the most effectively appropriate ear of the second person. For most right handed people, this ear will be the left ear. A second speech component is directed to the other ear, and includes the frequencies above the speaking fundamental frequency. The second speech component may include the entire spectrum, or preferably may be limited to that portion of speech above the speaking fundamental frequency. The device includes a method of stereo delivery of the sound, which is illustrated in this instance as a headset 16, but could include ear buds, or stereo speakers which are directed to individual sides of the second person's head. FIG. 2 illustrates the visual pathways to the two hemispheres of the human brain.

The following examples discuss experiments directed to the method of controlling the task completion of the second person. While the tasks discussed are specifically defined for the purpose of examining the invention, the tasks could broadly include various behaviors which demand a degree of attention of the second person and which benefit from the verbal communication or commands of the first person, including for example, driving, flying, delivery and deployment of ordinances, product delivery, excavation, exploration, fire fighting, surgery.

EXAMPLE 1

In this example, interacting partners were used for experimental dichotic manipulation of auditory variables (based on measures of elapsed time and accuracy in task completion). Right handed subjects were placed in separate rooms and asked to engage in a dyadic interaction with their partner via microphones and headsets as well as through a closed circuit video system. The audio signal from partners was routed through a two channel acoustic filter, giving the operator the ability to high/low pass filter the signals to both partners. The natural unfiltered audio signal from partners was recorded, as was the video signal. Three conditions for the experiment were established and labeled "Enhanced", "Confounded" and "Controlled". Two dependent variables were measured, task completion time, and task accuracy (is defined further herein). This example was intended to test the hypothesis that if a verbal signal is fed to the right ear, and a paraverbal signal is fed concurrently to the left ear, then the dichotic condition would produce an enhanced effect on partners' communications as measured for task completion and task accuracy (because each respective hemisphere is receiving its hypothetically appropriate signal). It was further postulated that if a verbal signal is fed to the left ear, and a paraverbal signal is fed concurrently to the right ear, then this dichotic condition would produce a confounded effect on partners communications in terms of task completion time and accuracy (i.e. because each respective hemisphere is receiving it hypothetically inappropriate signal). The natural unfiltered auditory signal fed monaurally to both ears represents the normal and non-dichotically managed condition and served in the example as a control to provide baseline values for task completion time and task accuracy (i.e. because each respective hemisphere is being treated uniformly and naturally.)

In order to methodically validate any observed differences between the three conditions described above (Enhanced, Confounded, and Controlled) the video and unaltered audio record of a randomly selected sample of interacting dyads from the Example was shown to groups of subjects who were asked individually to evaluate each member of the dyad as well as the entire conversation using a semantic differential instrument (as described below).

Subjects

Subjects for the example were unpaid undergraduate student volunteers. The volunteers were asked to complete the Internal Review Board Human Subjects form and Oldfield's (1970) handedness assessment inventory, which includes 12 items. If the subject favored the left hand for more than two of these 12 items, he/she were not allowed to continue with the experiment. Only subjects with a right hand preference were used for the Example in order to avoid the possibility that some lefthanders with a dominant right hemisphere would produce an unacceptable confound in the dichotic listening experiment. A total of 66 dyads (132 subjects) were used for this Example.

Experimental Procedure

On completion of the handedness inventory and acceptance as a subject for the experiment, subjects briefly met their respective partners in the anteroom outside the two experimental rooms, marked A and B, and then were ushered by the experiment administrator into their respective rooms. While inside the room, the administrator directed subjects' to be seated at a desk on which was affixed a 3'×2' plastic laminated sheet displaying 15 Rorschach inkblots, each distributed randomly over the sheet and labeled alphabetically for room A and numerically for room B. Subjects were asked to put on earphone/microphone headsets and were invited to view their partners, situated in the other room, via a wireless video communication system placed directly in front of them. Also placed on the desk in front of partners was an envelope containing directions for the experiment. Subjects were told to open the envelope and read the directions after the administrator left the room. The directions consisted of a brief statement instructing subjects to complete a task that involved matching each of the Rorschach inkblots by interacting via the headset and video monitor/recorder. Specifically, the task involved a subject in room A matching his or her alphabetically labeled inkblots to room B subjects' numerically labeled inkblots. Subjects were also asked to keep a record of their respective Rorschach matches on a form supplied to each of them, and to inform the administrator via the audio system when they had completed their task. When it was clear from the monitored conversation that subjects had begun to execute their task, the administrator started a timer and let it run until informed by the subjects that the task was completed, at which point the timer was stopped, and elapsed task completion time was recorded.

While subjects were performing their task, the administrator residing in the anteroom monitored subjects' conversations via an audio headset, operated an audio tape recorder of subjects' conversations, measured each of the dyads' elapsed times, and toggled the appropriate filter switches in accordance with a randomly allocated condition assignment. Records kept by the administrator for this experiment consisted of session identification, condition identification, subject's gender, elapsed time, unusual subject comments. Also, after completion of the dyad's task, the administrator scored the accuracy of the dyad's task performance from the subjects' Rorschach record forms and, finally, scored subjects' mutual evaluations from each of their forms. In reference to the point about filter switch operation, one of the administrator's duties was to operate the high/low pass electronic acoustic filter (Stewart VBF21M) in conformity with the protocol for testing each of the experimental conditions. The designation of a particular condition for each dyad was dictated by a table of random numbers, in which each of the dyads' condition types (Enhanced, Confounded or Controlled) was designated prior to subjects' being ushered into their respective rooms. To prepare the filter for a particular condition, the administrator operated appropriate toggle switches on the filter. For the Enhanced condition, switches were toggled to allow only frequencies below 0.35 Khz. to pass to subjects' left ears and only frequencies above 0.55 Khz. were allowed to pass to subjects' right ears. For the Confounded condition, switches were toggled to allow only frequencies below 0.35 Khz. to pass to subjects' right ears and only frequencies above 0.55 Khz. were allowed to pass to subject's left ears. The Stewart VBF21M electronic filter was set on 0.35 Khz. low pass for the paraverbal signal in order to assure that no discernible verbal communication was allowed to pass. Because this low pass signal is weakened by the elimination of the frequencies above 0.35 Khz., a 12 db. gain was imposed on the 0.35 Khz. low pass signal. As to the verbal signal, the filter was set on 0.55 Khz. high pass. In listening to the low pass signal, it is naturally perceived as a humanly vocalized, segmented, low pitched, humming sound, and the high pass signal is perceived as a notably crisp and easily discernible verbal signal. As noted in the text, the Controlled condition was not dichotically managed and thus the filter was set to route the signal through without any electronic alteration For the Controlled condition, filter switches were toggled so the entire unfiltered monaural acoustic signal was allowed to pass to both ears.

Analysis and Results of Example 1

Using the GLM procedure in SPSS, an ANOVA was conducted to compare the mean task completion times across the three conditions, Enhanced, Confounded and Controlled. The means, standard deviations, and sample sizes are shown in Table 1. Results from the ANOVA are presented in Table 2. The overall ANOVA for task completion time was significant, and post-hoc tests using a Bonferroni-adjusted alpha level of 0.017 (0.05/3=0.017) showed significant differences between subjects in the Enhanced condition and subjects in both the Confounded ($t(39)=-2.284$; one-tailed $p=0.014$) and Controlled ($t(42)=-2.746$; one-tailed $p=0.005$) conditions, but not between subjects in the Controlled and Confounded conditions ($t(45)=0.426$; one-tailed $p=0.336$). Though the relatively low mean task completion time for the Enhanced condition meets the postulated assertion for this project, it was not expected that the Controlled condition would have a greater (though not significantly greater) mean task completion time than the Confounded condition; however, this result does not depreciate the importance of the predicted result for the Enhanced condition. In the discussion of the Experiment below, a possible explanation is offered for the lower-than-expected mean task completion time for subjects in the Confounded condition vis-à-vis the Controlled condition.

TABLE 1

Means, Standard Deviations, and Sample Sizes for Task Completion Time by Condition

| Condition | Mean | Standard Deviation | n |
|---|---|---|---|
| Controlled | 14.191 | 3.401 | 25 |
| Confounded | 13.771 | 3.342 | 22 |
| Enhanced | 11.533 | 2.861 | 19 |

TABLE 2

Analysis of Variance for Effects of Condition on Task Completion Time

| Source | SS | DF | MS | F | p |
|---|---|---|---|---|---|
| Condition | 84.057 | 2 | 42.028 | 4.015 | .023 |
| Error | 659.464 | 63 | 10.468 | | |

Another ANOVA was conducted to compare the mean number of correct items (i.e., task accuracy) across the three conditions: Enhanced, Confounded, and Controlled. The means, standard deviations, and sample sizes are shown in Table 3. Results from the ANOVA are presented in Table 4. The overall ANOVA for task accuracy was significant, and post-hoc tests using a Bonferroni-adjusted alpha level of 0.017 showed significant differences between subjects in the Enhanced condition and subjects in the Controlled condition ($t(44)=2.515$; one-tailed $p=0.008$) and between subjects in the Controlled and Confounded conditions ($t(45)=2.366$; one-tailed $p=0.011$), but not between subjects in the Enhanced and Confounded conditions ($t(41)=0.136$; one-tailed $p=0.446$). Once again, though the relatively high mean task accuracy for subjects in the Enhanced condition vis-à-vis subjects in the Controlled condition meets the postulated assertion for this project, the inventors were surprised by the results pertaining to the Confounded condition, which was expected to have the lowest task accuracy. In the discussion of the Experiment below, a possible explanation is offered for the higher mean task accuracy for subjects in the Confounded condition compared with subjects in the Controlled condition.

TABLE 3

Means, Standard Deviations, and Sample Sizes for Task Accuracy (Number of Correct Items) by Condition

| Condition | Mean | Standard Deviation | n |
|---|---|---|---|
| Controlled | 13.920 | 1.288 | 25 |
| Confounded | 14.682 | .839 | 22 |
| Enhanced | 14.714 | .717 | 21 |

TABLE 4

Analysis of Variance for Effects of Condition on Task Accuracy

| Source | SS | DF | MS | F | p |
|---|---|---|---|---|---|
| Condition | 9.572 | 2 | 4.786 | 4.794 | .011 |
| Error | 64.898 | 65 | .998 | | |

Discussion of Results from Example 1

There are two possible explanations that could be influencing our results together or separately. First, the Controlled condition dyads were subjected to an identical monaural signal to both ears, and they may have experienced a cognitive overload state whereby the two acoustic signals input to both ears (both verbal and paraverbal) have to be relayed to the most appropriate location, which increases the cognitive processing time, increases tedium, and subsequently decreases task accuracy. By contrast, the Confounded condition, due to a more limited, though discrepant, dichotic processing pattern, does not provide these dyads with as much cognitive overloading, as only one set of two frequencies was sent contralaterally to each ear. It is possible that rerouting two signals contralaterally while retaining two signals ipsilaterally requires a greater cognitive load compared with a more efficient single contralateral switching procedure invoked for the Confounded condition. Second, the dichotically managed dyads experienced a split frequency with the low pass band bearing a 12 db. gain. The increased decibel intensity imposed upon the low pass band for the Confounded dyads may have enriched the signal for these dyads, thus improving their task completion times and task accuracy over the Controlled dyads who did not experience the increased paraverbal intensity.

Though there are some exceptions to the results of the Experiment, the mean 2.66-minute difference in task completion time between the Enhanced and Controlled conditions is remarkable. Not only is the finding statistically significant, but it has definite practical importance and implications as well.

EXAMPLE 2

The purpose of this study is to determine if subjects who experience the taped audio/visual record from a sample of dyads from each of the conditions in the Experiment are capable of discerning a measurable difference between the three conditions using a semantic differential instrument (described in detail below). In this Study, if subjects evaluate the Enhanced condition differently from the other two conditions, thereby exacting a more "positive" evaluation of Enhanced condition dyads, then there will be evidence from observers that in this setting the cerebral processing of the data has been accomplished in the most appropriate and efficient manner (i.e., the most adept cerebral facilities have been allocated for this process). On the other hand, if processing were to be performed by cerebrally less proficient areas, the dyadic interactions would be less favorably evaluated by outside observers.

Subjects and Procedures

In this study, subjects were unpaid undergraduate volunteers directed to report to a room in our facility where they completed the IRB forms and then were given a set of three semantic differential instruments with 34 items (refer to Appendix A). The three semantic differential instruments had different evaluation target stimuli appearing at the top of the page, but the 34 items were otherwise identical. Subjects were instructed to watch an audio/visual stimulus consisting of two partners from the Experiment conversing with one another. After watching each video, subjects were instructed to use the first two semantic differential forms to evaluate the two persons on the video stimulus separately (persons who were in rooms A and B for the Experiment), and then to use the third form to evaluate the entire conversation itself as appeared on the audio/visual stimulus. Each of the semantic differential forms were labeled "Person A (on the left)", and "Person B, (on the right)", and "Conversation". A total of 42 video tapes comprising 21 dyad pairs (a separate video was made of each of the subjects in rooms A and B) were used as stimuli for the Study. This sample of videos was produced by randomly selecting 7 dyad pairs from each of the three sets of conditions created for the Experiment. The audio/visual stimuli were designed by the University Tele-productions Laboratory where computer software was used to merge the individual dyadic partner videos into a split screen version with the subject from room A displayed on the left, and the subject from room B displayed on the right. The audio signal for this stimulus was the unfiltered conversation recorded by the video system. That is, subjects for the Study heard an unaltered audio version of the conversations between task interactants.

Each subject for the Study attended to and evaluated five randomly selected videos, and the experiment administrator was unaware of the condition assignments of the audio/visual stimuli, as videos were numerically labeled and the experimental condition identity of each was known only by the principal investigator. After subjects' completed the three semantic differential instruments, they were dismissed, and the semantic differential data were decoded using Experiment condition assignment codes obtained from the principal investigator.

Analysis and Results of Example 2

In total there were 52 semantic differential instruments completed for the Enhanced condition, 74 for the Confounded condition, and 65 for the Controlled condition. Data from the semantic differential instruments were first analyzed using SPSS factor analysis. These analyses were conducted separately on the data pertaining to Person A, Person B, and the entire Conversation using the principal components method of extraction with varimax rotation. In each case, the factor analyses of the 34 semantic differential items produced three factors that were labeled "evaluation," "potency," and "sociability." Separately for the Person A, Person B, and Conversation data, the "factor scores" corresponding to each factor for further analyses were saved. In order to maintain continuity in reporting the results of these analyses, the following section will report on the "Conversation" data first. And because some interesting serendipitous results derived from analyses of the "Person A" and "Person B" factor scores could suspend this report's continuity, they will be reserved for subsequent sections.

Results from the "Conversation" Audio/Visual Assessment

ANOVAs were conducted to examine whether the factor scores corresponding to each of the three factors (evaluation, potency, and sociability) derived from observer's assessments of the "Conversation" data differ across condition assignments from the Experiment. The factor-score means, standard deviations, and sample sizes for the "Conversation" data are shown in Table 5. The ANOVA results are summarized in Table 6. Of the three factors obtained from observers' assessments of the "Conversation" data, only the ANOVA for the factor scores corresponding to the first factor ("sociability") produced a significant result using "condition" as the independent variable. More specifically, post-hoc test comparisons using a Bonferroni-corrected alpha level of 0.017 between the Enhanced condition and the Confounded and Controlled conditions were both significant. The factor-score mean for "sociable" in the Enhanced condition is significantly less than the means for both the Confounded ($t(124)=-3.381$; one-tailed $p=0.001$) and Controlled ($t(115)=-2.327$; one-tailed $p=0.011$) conditions. Based on our coding of the response scales for the semantic differential items bearing on "sociability," this result indicates that dyadic interactions subjected to the Enhanced condition were assessed by observers in the Study as conveying a more positive "sociable" quality compared to dyadic interactions occurring in both the Confounded and Controlled settings from the Experiment. The Confounded condition is not significantly different from the Controlled condition ($t(137)=-1.116$; one-tailed $p=0.133$).

TABLE 5

Factor-Score Means, Standard Deviations, and Sample Sizes for "Conversation" Data by Component and Condition

| Component/Condition | Mean | Standard Deviation | n |
|---|---|---|---|
| Sociability | | | |
| Controlled | .043 | .952 | 65 |
| Confounded | .227 | .984 | 74 |
| Enhanced | −.377 | .990 | 52 |
| Evaluation | | | |
| Controlled | .012 | 1.017 | 65 |
| Confounded | −.045 | .984 | 74 |
| Enhanced | .050 | 1.018 | 52 |
| Power | | | |
| Controlled | −.027 | .983 | 65 |
| Confounded | −.074 | .971 | 74 |
| Enhanced | .139 | 1.065 | 52 |

TABLE 6

ANOVA Results for Effects of Condition on Sociability, Evaluation, and Power for "Conversation" Data

| Dependent Variable | Source | SS | DF | MS | F | p |
|---|---|---|---|---|---|---|
| Sociability | Condition | 11.309 | 2 | 5.655 | 5.949 | .003 |
| | Error | 178.691 | 188 | .950 | | |
| Evaluation | Condition | .286 | 2 | .143 | .142 | .868 |
| | Error | 189.714 | 188 | 1.009 | | |
| Power | Condition | 1.462 | 2 | .731 | .729 | .484 |
| | Error | 188.538 | 188 | 1.003 | | |

Discussion of the "Conversation" Audio/Visual Assessment Results

Results from analysis of the "Conversation" assessments of the audio/visual stimuli present strong evidence that the dichotically managed, Enhanced condition produces a robust, beneficial effect on observers' ratings of the quality of conversation in terms of "sociability" as compared with both the Confounded and Controlled conditions. In addition, though the dichotically managed Confounded condition is not significantly different from the Controlled condition, observers rated it less positively in terms of "sociability" than the Controlled condition, which confirms the theoretical direction as postulated by this report (but not at an acceptable level of significance). It is remarkable that subject observers in this Study who reviewed audio/visual records of sessions from the Experiment perceived "sociability" differences in what would commonly be conceived as an imperceptible distinction in interactions between partners. It is evident, however, that this dichotically managed SFF attribute is not such a subtle and inconsequential distinction for the non-conscious level of right cerebral hemisphere processing, but is rather a critically important ingredient in the manifold meaning expressed and comprehended in human communications.

Results from the "Person A (on the left)" and "Person B (on the right)" Audio/Visual Assessments Results of data analysis reveal a uniform difference in the way observers assessed Person A and Person B subjects in terms of the 34 semantic differential items.

Results from the "Person A (on the left)" Audio/Visual Assessment

The factor-score means, standard deviations, and sample sizes for the "Person A (on the left)" data are shown in Table 7. Like the foregoing analysis of the derived factor scores corresponding to these three factors, an ANOVA produced a significant result for the "sociability" dimension (see Table 8). Bonferroni-corrected post-hoc test comparisons of the "sociability" factor-score means revealed a significant difference between the Enhanced and Confounded conditions ($t(124)=-3.135$; one-tailed $p=0.001$). Also, Person A in the controlled condition was rated by observers as being less "sociable" than Person A from the Enhanced condition, at least directionally, but this was not statistically significant ($t(115)=-0.997$; one-tailed $p=0.160$). Also, the controlled condition in this case was not significantly different from the confounded condition ($t(137)=0.597$; one-tailed $p=0.276$) Again, based on the coding of the response scales for the semantic differential items bearing on "sociability," these results indicate that Person A in the Enhanced condition was assessed by observers in the Study as conveying a more "sociable" quality compared to Person A in the Confounded setting from the Experiment.

TABLE 7

Factor-Score Means, Standard Deviations, and Sample Sizes for "Person A (on the left)" Data by Component and Condition

| Component/Condition | Mean | Standard Deviation | n |
|---|---|---|---|
| Sociability | | | |
| Controlled | −.098 | .955 | 65 |
| Confounded | .282 | .976 | 74 |
| Enhanced | −.279 | 1.005 | 52 |
| Evaluation | | | |
| Controlled | .111 | 1.037 | 65 |
| Confounded | .101 | .771 | 74 |
| Enhanced | −.283 | 1.188 | 52 |

TABLE 7-continued

Factor-Score Means, Standard Deviations, and Sample Sizes for "Person A (on the left)" Data by Component and Condition

| Component/Condition | Mean | Standard Deviation | n |
|---|---|---|---|
| Power | | | |
| Controlled | −.006 | .855 | 65 |
| Confounded | .035 | .985 | 74 |
| Enhanced | −.042 | 1.190 | 52 |

TABLE 8

ANOVA Results for Effects of Condition on Sociability, Evaluation, and Power for "Person A (on the left)" Data

| Dependent Variable | Source | SS | DF | MS | F | p |
|---|---|---|---|---|---|---|
| Sociability | Condition | 10.533 | 2 | 5.267 | 5.517 | .005 |
| | Error | 179.467 | 188 | .955 | | |
| Evaluation | Condition | 5.736 | 2 | 2.868 | 2.926 | .056 |
| | Error | 184.264 | 188 | .980 | | |
| Power | Condition | .183 | 2 | .091 | .090 | .914 |
| | Error | 189.817 | 188 | 1.010 | | |

Results from the "Person B (on the Right)" Audio/Visual Assessment

The factor-score means, standard deviations, and sample sized for the "Person B (on the right)" data are shown in Table 9. Unlike the foregoing analyses of the derived factor scores for the "Conversation" and "Person A (on the left)" data, an ANOVA here (see Table 10) produced a significant result only for the factor scores corresponding to the "potency" factor (which was not significant in any of the previous analyses). Bonferroni-corrected post-hoc test comparisons revealed significant differences between the Enhanced and Confounded conditions ($t(124)=-3.110$; one-tailed $p=0.001$), as well as between the Confounded and Controlled conditions ($t(137)=-2.859$; one-tailed $p=0.003$). But there was no significant difference between the enhanced and controlled conditions ($t(115)=-0.609$; one-tailed $p=0.272$)

TABLE 9

Factor-Score Means, Standard Deviations, and Sample Sizes for "Person B (on the right)" Data by Component and Condition

| Component/Condition | Mean | Standard Deviation | n |
|---|---|---|---|
| Sociability | | | |
| Controlled | −.037 | .965 | 65 |
| Confounded | .108 | .952 | 74 |
| Enhanced | −.110 | 1.108 | 52 |
| Evaluation | | | |
| Controlled | .152 | 1.028 | 65 |
| Confounded | −.104 | .884 | 74 |
| Enhanced | −.042 | 1.111 | 52 |
| Power | | | |
| Controlled | .147 | .899 | 65 |
| Confounded | −.310 | .977 | 74 |
| Enhanced | .257 | 1.053 | 52 |

Based on the coding of the response scales for the semantic differential items bearing on "potency" (positive means denote lesser potency), these results indicate in summary that (1) Person B in the Enhanced condition was assessed by observers in the Study as conveying a less "potent" or powerful quality compared to Person B in the Confounded setting from the Experiment, and (2) Person B in the Controlled condition was assessed by observers in the Study as conveying a more "potent" quality compared to Person B in the Confounded setting.

Discussion of the "Person A (on the Left)" and "Person B (on the Right)" Audio/Visual Assessments On an intuitive basis it would be expected that results from the Person A and B analyses would be similar, as subjects were assigned to the rooms on a random basis. However, as noted above, this intuition was not confirmed. It is postulated that understanding the Person A and B results is more dependent upon how the Study subjects perceived the placement of stimuli, as opposed to the qualitative content of the stimuli perceived. In other words, if Person A and B were to be switched on the screen (i.e., if Person A was switched to the right, and Person B was switched to the left), the same anomalous result would be expected. Hypothetically, this result would not be the product of any quality of the stimulus, but rather the product of the stimuli placement on the monitor screen.

With knowledge obtained from split brain, stroke and lesion studies, as well as the brief discussion of the lateralized functions of the hemispheres, an explanation can be put together of the anomalous results from the Person A and B data. As noted above, subjects who observed the split screen stimuli would attend visually and audiologically to Person A or B. Later they completed three semantic differential forms that asked them to provide their assessments of Conversation as whole as well as Persons A and B, individually. The results from the Conversation data showed a significant difference between the three conditions for scores corresponding to Factor 1, which was the "sociability" factor, and results for the Person A data showed a significant result for Factor 2, which was also the "sociability" factor. However, results for Person B showed significance for factor scores corresponding to Factor 2, which in this case was a "potency" factor.

In completing their semantic differential forms, subjects had to rely on memory in order to retrieve details of their perceptions of Persons A, B and Conversation. Memory traces from subjects' experience reside in brain modules most equipped for processing particular stimuli, and when subjects are called upon to recollect their experience, the brain collects information from the cognitively most appropriate locations (Paivio, 1971; Bradshaw, et al, 1976; Milner & Dunne, 1977). Memory retrieval for Conversation involves an inferential and conceptual task of combining memory traces from a number of cognitive locations (audio/visual data from both Persons A and B), whereas individual memory retrieval for each Person A and B consists of an entirely different type of cognitive processing. In retrieval of Person A or B information, subjects are attending to a more perceptual set of memory traces and rely less on inferential and conceptual cognitive performances. The left hemisphere is responsible for memory inference and theory creation input to the reporting process (Phelps & Gazzaniga, 1992; Gazzaniga, 2000), whereas the right hemisphere is more literal, in that it deals with actually witnessed memory as opposed to inferences (Metcalf, Funnell & Gazzaniga, 1995). Also, the left hemisphere processes semantic qualities in a markedly different manner than the right. The left hemisphere in its operation has been characterized as dominant in most cognitive psychology literatures from Broca's time to the present. Though this characterization was originally deemed valid—predominantly owing to its connection with dominance of right handedness—the symbolic connectedness of the left hemisphere with such terms in the semantic differential as dominant/ submissive, strong/weak, aggressive/timid, tough/fragile, show this symbolic, semantic connectedness. Most importantly in this connection, the inventors of the semantic differential (Osgood, Suci and Tannenbaum, 1957) who used cue terms "Left" and "Right" respectively, at the top of two of their early questionnaires, derived results showing "Right" (in this case evidently referring to the right side or hand) as being associated with a potency semantic and "Left" being associated with an opposite semantic (Domhoff, 1974). Their results relate directly with those discussed in Robert Hertz's classic anthropological survey as reported in his essay, "The Pre-eminence of the Right Hand: A Study in Religious Polarity" (Hertz, 1909). In addition, the left hemisphere is qualitatively associated with quantitative, linear reasoning, which roughly equates with logic, ranking, hierarchical ordering, law, and politics (Needham 1982; Bradshaw & Nettleton 1983; Geschwind & Galaburda 1987). This qualitative symbolic mode of left hemisphere semantic processing in addition to its inferential and interpretational capacities (Phelps and Gazzaniga 1992; Corballis, Funnell & Gazzaniga 1999) thus allows the conjunction of direct visual information from Person B with a normal audio signal; but the left hemisphere depends, as well, upon the right hemisphere's affective input on Person B to augment its assessment.

The information contributes to explaining the differences shown across the three versions of the semantic differential instrument (Conversation, Person A and Person B). Recall both Conversation and Person A results are similar because both showed a significant "sociability" factor; however, the Person B results showed a significant "potency" factor. These differences may be explained as resulting from the visual field positioning of Person A and B on the video monitor. Person A is viewed by subjects primarily with the right retinal field of the right eye and thus the visual memory of Person A is stored ipsilaterally in the right hemisphere along with the audio memory. When subjects recall their memory of Person A, for semantic differential reporting purposes, the left hemisphere receives processed input from the right hemisphere, which by design—according to the postulate of this research—deals best with the conjunction of SFF/audio and facial/visual information (Hilliard, 1973; Berlucci, et al, 1974; Funell, Corbalis & Gazzaniga, 2001; Miller, Kingstone & Gazzaniga, 2002). The right hemisphere presents the left with consistently processed audio and visual information based upon its recalled memory of its visually witnessed stimuli, Person A. This information from the right hemisphere is imbued with affect—particularly for the Enhanced dyads and "sociability" items—that is reported by the left hemisphere into the appropriate items reported on the semantic differential. Because both the audio and visual information for Person A has been derived from witnessed memory by the right hemisphere and then passed via the corpus callosum to the left hemisphere, there is no need for the left hemisphere to provide an inferentially conceived product from its own cerebral resources; it merely reports the consistent information given it: the left hemisphere directly reports the consistent right hemisphere affective information to the semantic differential instrument, which is reported as a "sociability" factor for Person A.

The Enhanced condition dyads were rated significantly different on the basis of higher mean ratings for "sociability" in comparison with the other conditions' dyads, both for "Conversation" and "Person A" semantic differentials. This result occurred because the left and right hemispheres of evaluating subjects functioned together on an optimal basis in producing this result. However, the processing task for evaluation of Person B involves a possibly less optimal cerebral function that relates well with some of the points made earlier in this discussion. Person B is viewed primarily with the left retinal field of the left eye, and the visual memory of Person B is stored ipsilaterally in the left hemisphere along with the memory trace of the audio signal from Person B. When subjects recall their memory of Person B for semantic differential reporting, the left hemisphere makes use of its witnessed ipsilaterally received visual input in relation to its audio input. The left hemisphere in dealing with its visual stimuli sets a general orientation in assessing the Person B that is most predominately a relative ranking with a political component (Needham 1982; Bradshaw & Nettleton 1983; Geschwind & Galaburda 1987), which reflects the zero-sum nature of "potency" items—aggressive/timid, dominant/submissive, et cetera—when judging persons in dyads. The right hemisphere conceives such items as generally antithetical to the primary feature of its affective stature for comparing the three types of dyads. It is apparent that subjects when assessing the Enhanced dyads conceived "sociable" persons as not showing aggression or dominance. Thus, when the left hemisphere summons the right hemisphere for affective information on its Person B stimulus it receives a significantly, negatively biased assessment—diminished levels of "potency"—for the Enhanced dyads as compared with the others. This results in the discrepancy between the assessments of the Conversation/Person A with Person B semantic differentials. As noted above, it is suggested that this same result would occur if the Person A and B stimuli were to be interchanged.

TABLE 10

ANOVA Results for Effects of Condition on Sociability, Evaluation, and Power for "Person B (on the right)" Data

| Dependent Variable | Source | SS | DF | MS | F | p |
|---|---|---|---|---|---|---|
| Sociability | Condition | 1.538 | 2 | .769 | .767 | .466 |
| | Error | 188.462 | 188 | 1.002 | | |
| Evaluation | Condition | 2.407 | 2 | 1.204 | 1.206 | .302 |
| | Error | 187.593 | 188 | .998 | | |
| Power | Condition | 11.986 | 2 | 5.993 | 6.329 | .002 |
| | Error | 178.014 | 188 | .947 | | |

It is clear from results of the foregoing research that dichotic enhancement is effective in producing a more efficacious communication signal in comparison with a confounded or even a natural monaural signal for partners in dyadic conversations. It is also clear that this finding supports the assertion that the mainspring of SFF processing is located in the right hemisphere. The extended discussion above dealing with the anomalous findings from Persons A and B analysis, though conjectural, offers further substantiation of the efficacious effect of dichotic enhancement.

EXAMPLE 3

As a further example, the present invention was applied to a driving simulation experiment. Accordingly, in an automobile driving task that simulates a real life experience of driving in low density traffic, subjects received driving directions and a challenging cognitive task as they interacted with an experiment administrator via a dichotically filtered electronic communication system. While subjects operated the simulated vehicle (Simulator Systems International, S-3300) the experimenter gave driving directions (e.g., "Turn right at the next intersection," "Change into the left lane," etc.) and administered a series of cognitive task problems where subjects were instructed to repeat digit strings, such as 63897, either forward (63897) or in reverse (79836). All subjects received the same driving directions and task problems. Subjects interacted with the experimenter by means of headsets consisting of headphones and an integrated microphone. The audio speech signal were routed from the experimenter to the subject through an electronic, dual channel high/low pass acoustic filter (Stewart VBF21M). Subjects were randomly assigned to one of two experimental conditions. In the enhanced condition, the experimenter's audio communications were altered "dichotically" by setting the filter to send (i) the low frequency speech signal (beneath 0.35 kHz) to the subject's left ear and thus to the right cerebral hemisphere, and (ii) the high frequency speech signal (above 0.55 kHz) to the subject's right ear and thus the left cerebral hemisphere. The speech signal is split into two bands, below 0.35 kHz for the SFF, and above 0.55 kHz for the verbal band. The low frequency SFF band was given a 12 db gain to improve the audibility of this inherently weak intensity value. These low/high pass values were established in prior studies (Gregory, Jr., S. W. (1990). Analysis of fundamental frequency reveals covariation in interview partner's speech. *Journal of Nonverbal Behavior,* 14, 237-251. Gregory, Jr., S. W. (1994). Sounds of power and deference: acoustic analysis of macro social constraints on micro interaction, *Sociological Perspectives,* 37, 497-526. In the control condition, the filter was bypassed, thus sending the same non-dichotically altered, monaural signal to both ears.

A total of 59 subjects participated in this experiment; 28 in the enhanced condition and 31 in the control condition. Handedness is a strong predictor of hemispheric dominance for verbal processing. To diminish a confound in this regard, all subjects were administered the Oldfield handedness inventory as defined in Oldfield, R. C. (1970). The assessment and analysis of handedness: the Edinbrugh inventory *Neuropsychologia,* 9, 97-113, and only right-handed subjects were allowed to participate in this experiment. Two outcomes from the simulation were chosen as the focus. The first is subjects' ability to finish the driving course without experiencing a simulator cessation event (e.g., rear-ending another car, head-on collision, etc.). This is referred to this as the crash outcome. A crash outcome causes the simulator to terminate its session, and is not a judgment made by the experimenter. The second outcome is subjects' performance on the digit-repetition task while driving. This is referred to as the task outcome.

Analysis and Results of Example 3

With respect to the first outcome, subjects in the enhanced condition experienced significantly fewer crashes in the driving simulator than subjects in the control condition. As summarized in FIG. 3, 14 of the 31 subjects in the control condition (45.2%) experienced a crash compared to only 5 of the 28 subjects in the enhanced condition (17.9%). Thus the dichotically enhanced setting reduced crashes by 60 percent. Furthermore, logistic regression results shown in Table 1 reveal that the odds of crashing are significantly greater in the control condition compared to the enhanced condition, net of years of driving experience, number of moving violations, and average number of hours spent each week playing video games. Data was obtained on years of driving experience, number of moving violations, and number of hours spent playing video games by means of a pencil-and-paper questionnaire administered at the end of the study, Specifically, the odds of crashing were almost six times greater in the control condition compared to the enhanced condition, net of the control variables. Finally, results of a survival analysis, which compares the entire "survival" experience between groups (see FIG. 3), indicate that the risk of crashing at any point during the simulation is significantly lower for subjects in the enhanced condition in comparison with the control condition.

Figure 3:
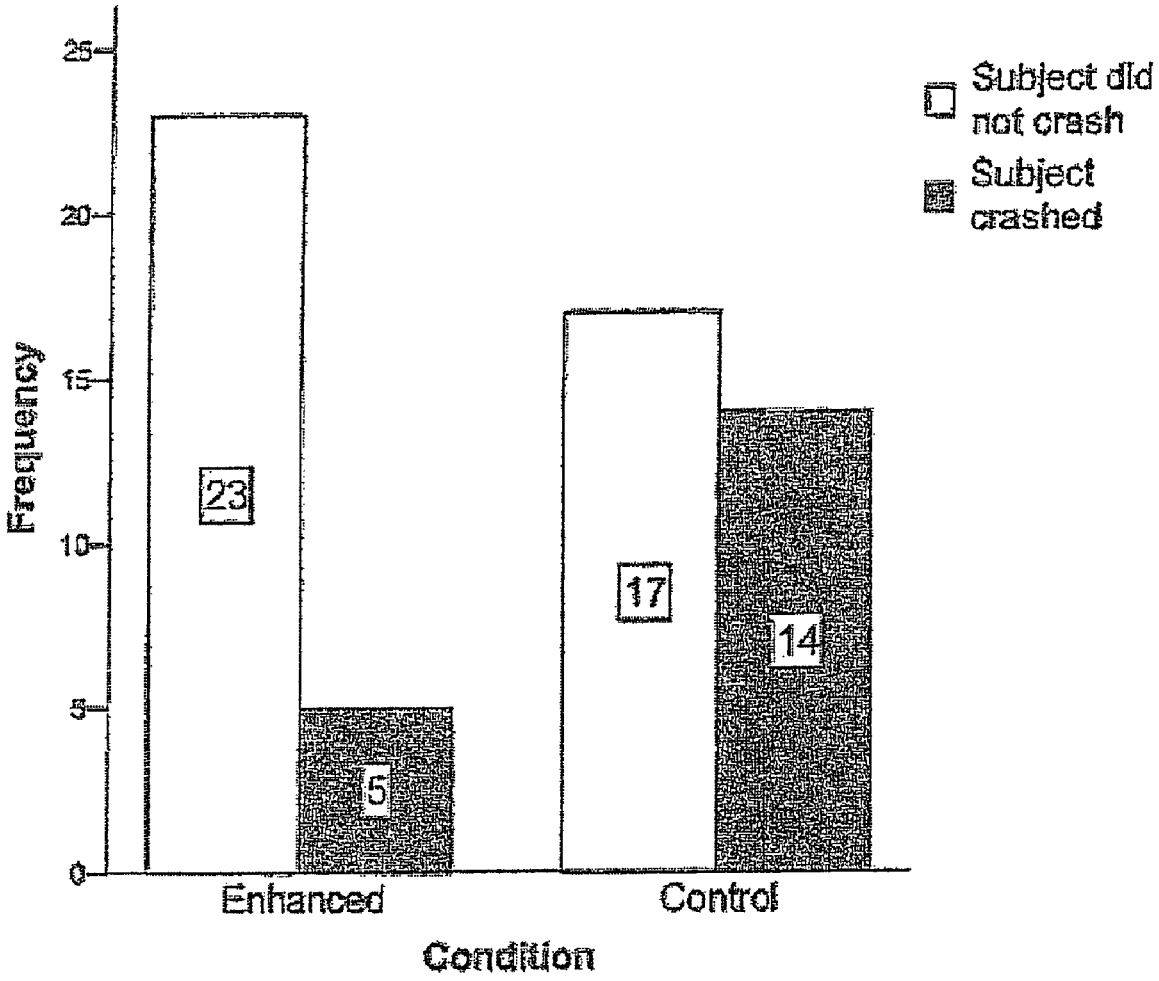
FIG. 3 is a graph showing the Pearson chi-square test of independence plotting the relationship between crash frequency and experimental condition.

FIG. 3 shows crash frequency during driving simulation by experimental condition and is the results of a Pearson chi-square test of independence reveal that the relationship between crash frequency and experimental condition is statistically significant ($\chi^2$=5.024, df=1, p=0.025). That is, the distribution of frequencies shown in the graph is not due to chance.

Table 11 is a summary of logistic regression analysis for the effect of experimental condition on crashes. The outcome, crash, is coded 1 for crash and 0 for no crash. Condition is coded 0 for enhanced and 1 for control. Driving experience (in years) is scored from 1=less than one to 6=five or more. Total moving violations is scored from 1=none to 6=five or more. Video gaming (weekly average in hours) is scored from 1=none to 6=five or more. $e^B$ is the exponentiated B, or "odds ratio." As a predictor changes one unit, the odds that the outcome=1 (i.e., crash) increase by a factor of 1, net of the other predictors in the model. For example, as "Condition" changes from "enhanced" (0) to "control" (1), the odds of a crash increase by a factor of 5.925, net of driving experience, moving violations, and video gaming. Condition is the only statistically significant predictor in the model (i.e., Probability<0.05).

TABLE 11

Summary of Logistic Regression Analysis for the Effect of Experimental Condition on Crashes.

| Predictor | B | SE B | Probability | $e^B$ |
|---|---|---|---|---|
| Condition | 1.779 | .703 | .011 | 5.925 |
| Control Variables | | | | |
| Driving Experience | −.442 | .272 | .103 | 2.651 |
| Moving Violations | .487 | .400 | .223 | 1.487 |
| Video Gaming | −.277 | .303 | .360 | .836 |
| Constant | −.581 | 1.035 | .574 | .316 |

Figure 4:
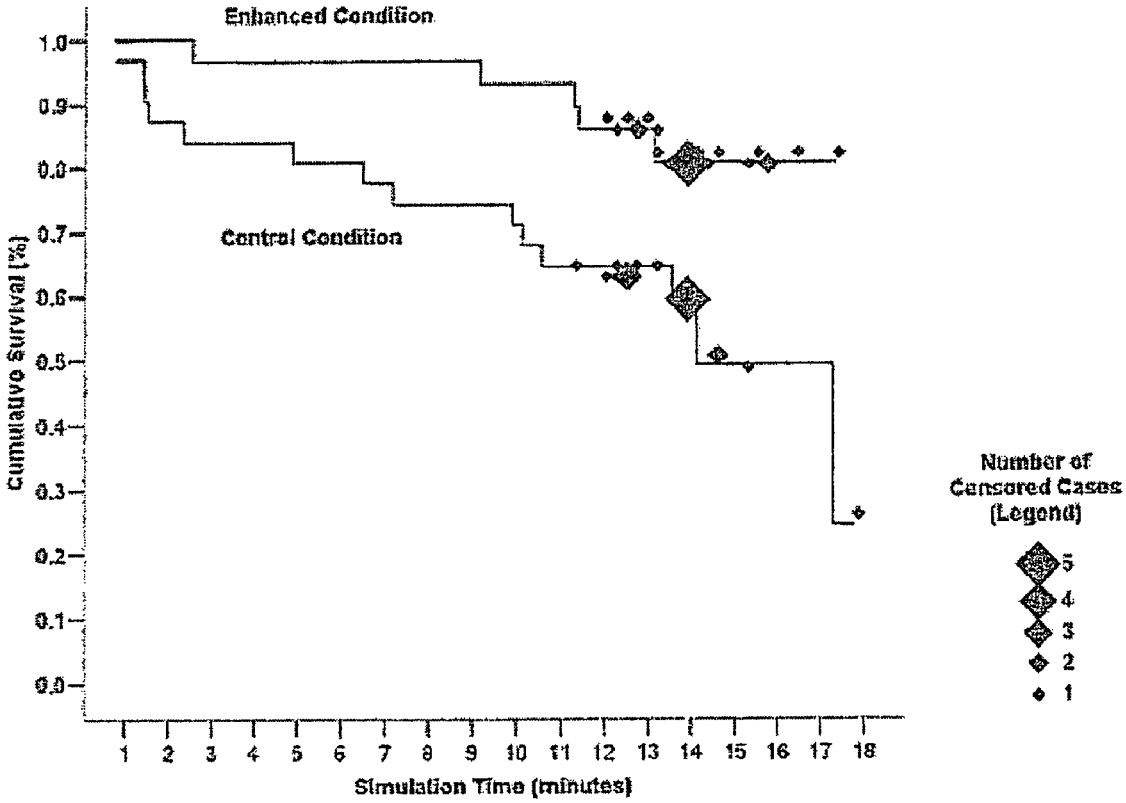
FIG. 4 is a graph showing the percentage of subjects who have not experienced a simulator cessation event (i.e., a crash) by a given point in time (the horizontal axis) during the simulation.

FIG. 4 is a survival functions by experimental condition. Cumulative survival is the percentage of subjects who have not experienced a simulator cessation event (i.e., a crash) by a given point in time (the horizontal axis) during the simulation. "Censored" cases (represented by diamond-shaped symbols) are subjects who completed the driving course without experiencing a simulator cessation event (i.e., crash). Results of a log rank (Mantel-Cox) test reveal that the survival curves for the enhanced group and the control group are significantly different ($\chi^2$=5.107, df=1, p=0.024).

Figure 5:
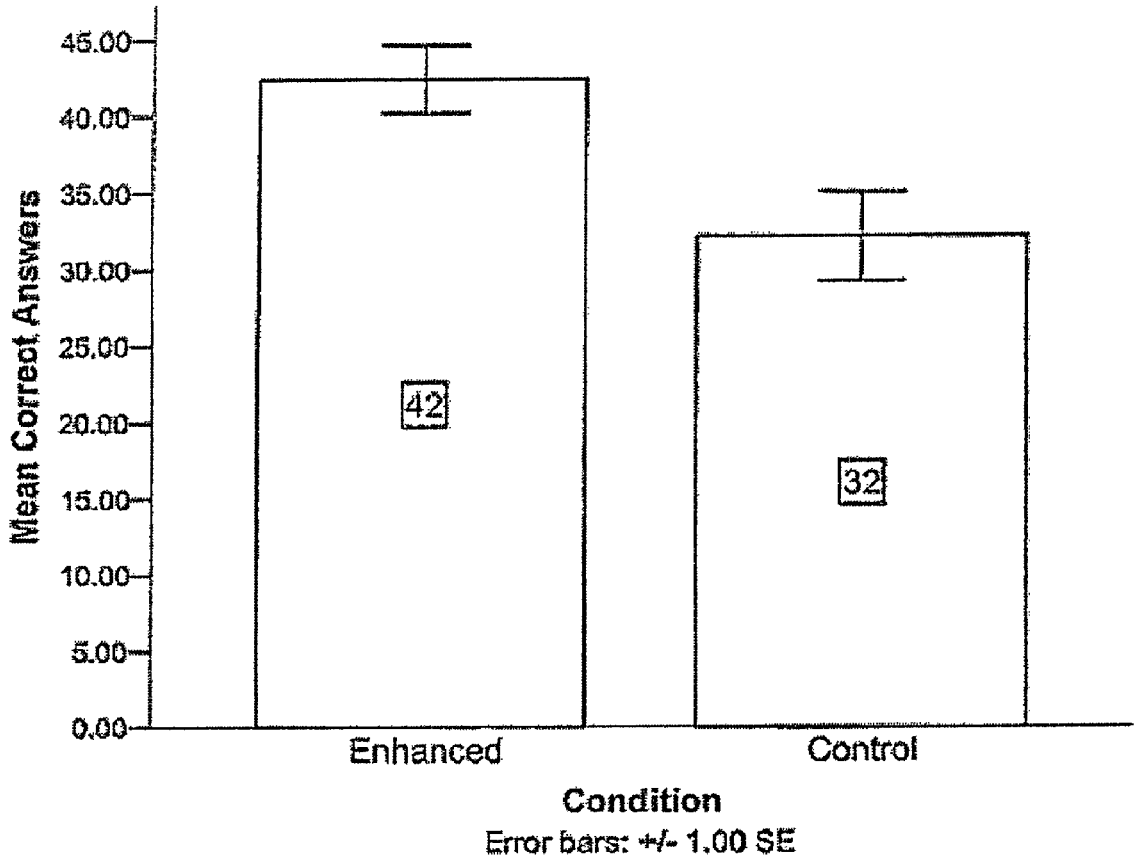
FIG. 5 is a graph showing an independent means t-test of cognitive task accuracy by experimental condition.

Regarding the second outcome, subjects in the enhanced condition completed the digit-repetition task while undergoing the simulated driving experience with significantly greater accuracy than subjects in the control condition. Subjects in the enhanced condition gave 42 correct answers, on average, while subjects in the control condition gave an average of 32 correct answers. Thus accuracy was improved by 24 percent in the enhanced condition compared to the control condition. This result is summarized in FIG. 5. FIG. 5 represents the cognitive task accuracy by experimental condition. Results of an independent means t-test reveal that the condition means are significantly different (t=2.766, df=57, two-tailed p=0.008). That is, the observed mean difference between conditions is not due to chance.

Discussion of Results from Example 3

Overall, the results of this experiment suggest that cognitive load difficulties can be alleviated by means of enhanced dichotic listening devices which route sensory signals to areas of the brain that are best equipped to process them. It is thus possible that common problems associated with safety, accuracy, and timeliness can be mitigated in situations where individuals operate advanced technological equipment and perform subsidiary tasks while interacting via electronic means (e.g., cell phone use and driving, air-to-air and air-to-ground controller communications, etc.).

Modern communications are increasingly conditioned by use of technological devices that stand in for or even prevent direct face-to-face interaction between persons. There is no indication that the future will lessen propensity toward increased employment of indirect communications via electronic technology. It is more highly probable that this propensity will markedly increase. Thus any new and dedicated electronic technology that increases enhancement of interpersonal communications, possibly even beyond the traditionally more direct face-to-face approach, can be useful.

The findings from this research are presently being used to test a variety of different audio devices that can lead to improved electronic communications. For example, the present invention has as an application, a dichotic protocol adapted to cell phone use by auto drivers. Currently, there is concern that simultaneous operation of autos and cell phones can be hazardous in certain conditions. Experimentation with various configurations of dichotic devices can lead to enhanced driver safety while maintaining or improving electronic communications satisfaction for the driver. This application is being tested through experimentation that simulates simultaneous operation of autos and cell phones by observing experimental subjects as they carry on cell phone conversations while operating a driving simulator. The driving simulator can be programmed to present the subject with a myriad array of normal and hazardous weather and traffic conditions that assess driving ability simultaneous with cell phone operation. A separate, but related application relates to ground traffic control of aircraft, for both civilian and military use. Of course, the later also encompasses the use of the present invention for air to ground deployment of cargo, including personnel, ordinances, supplies, or any other payloads. A similar type of simulated simultaneous communications and conveyance operations experience is being considered as well between aircraft ground controllers and air crews in congested air traffic and inclement weather conditions.

The invention has similar application in other circumstances involving closed circuit communication, such as remote control of troop and safety personnel, for example for crowd or security control, for fire, and for remote operations under potentially hazardous conditions, such as mining, or exploration underground or underwater. Finally, as the invention assists in providing for better electronic communication it may also enhance the sensation of direct or natural communication notwithstanding the use of electronic means of delivery, such as for forms of virtual reality including electronic gaming and high end amusement rides.

APPENDIX A

Semantic Differential
(Target stimuli appearing top of each page for the semantic differential are labeled as "Conversation", "Person A (on the left) and "Person B (on the right))

| | | | |
|---|---|---|---|
| Item 1[a] | Erratic | | Constant |
| Item 2 | Comfortable | | Uncomfortable |
| Item 3 | Important | | Unimportant |

APPENDIX A-continued

Semantic Differential
(Target stimuli appearing top of each page for the semantic differential are labeled as "Conversation", "Person A (on the left) and "Person B (on the right))

| | | | |
|---|---|---|---|
| Item 4 | Friendly | | Unfriendly |
| Item 5 | Valuable | | Worthless |
| Item 6 | Loud | | Soft |
| Item 7[a] | Submissive | | Dominant |
| Item 8[a] | Tense | | Relaxed |
| Item 9 | Pleasant | | Unpleasant |
| Item 10 | Moving | | Still |
| Item 11 | Interesting | | Boring |
| Item 12 | Relevant | | Irrelevant |
| Item 13 | Secure | | Insecure |
| Item 14[a] | Unsociable | | Sociable |
| Item 15[a] | Serious | | Humorous |
| Item 16 | Tough | | Fragile |
| Item 17 | Deep | | Shallow |
| Item 18 | Aggressive | | Timid |
| Item 19 | Meaningful | | Meaningless |
| Item 20[a] | Bad | | Good |
| Item 21 | Happy | | Sad |
| Item 22[a] | Low | | High |
| Item 23 | Hard | | Soft |
| Item 24[a] | Passive | | Active |
| Item 25 | Strong | | Weak |
| Item 26 | Calm | | Excitable |
| Item 27 | Like | | Dislike |
| Item 28[a] | Simple | | Complex |
| Item 29[a] | Dead | | Alive |

APPENDIX A-continued

| Semantic Differential (Target stimuli appearing top of each page for the semantic differential are labeled as "Conversation", "Person A (on the left) and "Person B (on the right)) | | | |
|---|---|---|---|
| Item 30 | Intense | _ \| \| \| \| \| \| _ | Mild |
| Item 31 | Clear | _ \| \| \| \| \| \| _ | Hazy |
| Item 32[a] | Dull | _ \| \| \| \| \| \| _ | Sharp |

While in accordance with the patent statutes the best mode and preferred embodiment have been set forth, the scope of the invention is not limited thereto, but rather by the scope of the attached claims.

What is claimed is:

1. A method of enhancing the efficiency or accuracy of completion of a task during remote communication transmitted electronically between a first person and a second person where at least the first person engages in speech for the benefit of the second person and the second person engages in the task, the method comprising the steps of modifying the speech of at least the first person transmitted to the second person by inputting the speech of the first person to a device that includes an audio filter;

defining a first speech component and a second speech component for the first person, the first speech components comprising the speech fundamental frequency which is the speech component below 0.75 Khz, and the second speech component including the speech component above 0.75 Khz, using the device to filter the inputted vocalization to isolate the first speech component;

augmenting the first speech component for the first person by increasing the relative volume of the first speech component by at least 5 db;

transmitting the augmented first speech component to only one of the left or the right ear of the second person; and transmitting the second speech component to the other of the left and right ear of the second person.

2. A method as set forth in claim 1 wherein the task is one or more of driving, flying, fighting fires, mining, deploying weapons, controlling crowds, and fighting crime or teaching one or more of driving, flying, fighting fires, mining, deploying weapons, controlling crowds, and fighting crime.

3. A method as set forth in claim 2 wherein both the first and the second person are speaking and the speech of the second person transmitted to the first person is modified by inputting the vocalization of the second person to a device that includes an audio filter;

defining a first speech component and a second speech component for the second person, the first speech component comprising the speech fundamental frequency which is the speech component below 0.75 Khz, and the second speech component including the speech component above 0.75 Khz, using the device to filter the inputted vocalization of the second person to isolate the first speech component;

augmenting the first speech component of the second person by increasing the relative volume of the speech fundamental frequency by at least 5 db;

transmitting the augmented speech fundamental frequency to only one of the left or the right ear of the first person; and transmitting the second speech component to the other of the left and right ear of the first person.

4. A method as set forth in claim 1 wherein the augmented speech fundamental frequency is transmitted to a preferred one ear of the right and left ears and the method further includes the step of determining the preferred one ear.

5. A method as set forth in claim 4 wherein the step of determining the preferred one ear includes determining the dominant hand of the second person and correlating that to the preferred ear.

6. A method as set forth in claim 5 wherein the dominant hand is determined by administering a handedness inventory.

7. A method as set forth in claim 1 wherein the first speech component is the speech component below 0.5 Khz.

8. A method as set forth in claim 7 wherein the first speech component is the speech component below 0.35 Khz.

9. A method as set forth in claim 8 wherein the audio filter is a frequency filter.

10. A method as set forth in claim 9 wherein the audio filter is an amplitude filter.

11. A method as set forth in claim 1 wherein the first speech component is transmitted to the left ear of the second person.

12. A method as set forth in claim 1 wherein the second person is in a moving vehicle.

13. A method as set forth in claim 12 wherein the vehicle is an automobile or truck.

14. A method asset forth in claim 12 wherein the vehicle is a plane.

15. A method as set forth in claim 12 wherein the vehicle is a helicopter.

16. A method as set forth in claim 1 wherein the second person receives the first or the second speech component through a helmet.

17. A method as set forth in claim 1 wherein the second person is in a device which simulates a situation.

18. A method of enhancing the accuracy or speed of flight traffic control in which a pilot is directed by an air traffic controller during flight comprising the steps of in putting the vocalization of the air traffic controller to a device that includes an audio filter, the inputted vocalization comprising a speech directive;

defining a first speech component and a second speech component, the first speech component comprising the speech fundamental frequency of the speech directive which is below 0.75 KHz and the second speech component including the frequency of the speech directive above 0.75 Khz;

using the device to filter the inputted vocalization to isolate the first speech component;

augmenting the speech fundamental frequency by increasing the relative volume of the speech fundamental frequency by at least 5 db;

transmitting the speech directive to at least the right ear of the pilot; and inputting the augmented speech fundamental frequency to only one of the left or the right ear of the pilot.

19. A method as set forth in claim 18 wherein the augmented speech fundamental frequency is transmitted to a preferred one ear of the right and left ears and the method further includes the step of determining the preferred one ear.

20. A method as set forth in claim 19 wherein the step of determining the preferred one ear includes determining the dominant hand of the pilot and correlating that to the preferred ear.

21. A method as set forth in claim 20 wherein the dominant hand is determined by administering a handedness inventory.

22. A method as set forth in claim 21 wherein the speech fundamental frequency is augmented by at least 10 db to 15 db.

23. A device for enhancing the efficiency or accuracy of completion of a task undertaken by a first person during remote communication with the first person by a second person comprising a receiver which receives the vocalizations of the first person;

a transmitter which transmits the vocalizations to the second person;

a filter which separates the vocalizations into a first speech component and a second speech component, the first speech component including the speaking fundamental frequency which is the isolated frequency of the vocalization below 0.75 Khz which has also been augmented by increasing the relative volume of the isolated frequency by at least 5 db; and a left speaker for the left ear of the first person and a right speaker for the right ear of the first person, one of the left and right speaker capable of transmitting the first speech component and the other of the left and right speaker capable of transmitting the second speech component.

24. A device as set forth in claim 23 wherein the filter isolates the frequency below 0.5 Khz for the speaking fundamental frequency.

25. A device as set forth in claim 24 wherein the filter isolates the frequency below 0.35 Khz for the speaking fundamental frequency.

26. A device as set forth in claim 25 wherein the filter augments the relative volume of the isolated frequency by 10 db to 15 db.

27. A device as set forth in claim 26 which comprises a simulator or virtual reality device.

28. A device as set forth in claim 26 which comprises a teaching device that simulates a situation.

29. A device as set forth in claim 27 which comprises a component of a vehicle.

30. A device as set forth in claim 27 wherein the vehicle is a plane.

31. A device as set forth in claim 27 wherein the vehicle is a helicopter.

32. A device as set forth in claim 27 wherein the vehicle is an automobile or truck.

33. A device as set forth in claim 27 wherein the device comprises a helmet.

34. A device as set forth in claim 27 wherein the device comprises earphones.

* * * * *

UNITED STATES PATENT AND TRADEMARK OFFICE

CERTIFICATE OF CORRECTION

PATENT NO. : 8,000,958 B2
APPLICATION NO. : 11/803315
DATED : August 16, 2011
INVENTOR(S) : Gregory, Jr. et al.

It is certified that error appears in the above-identified patent and that said Letters Patent is hereby corrected as shown below:

TITLE PAGE:

In section (75) on the face of the patent, please correct the second named inventor to read --Kalkoff-- not "Kalkhoft" as listed on the Declaration.

IN THE CLAIMS:

In claim 14, column 20, line 30, please delete "asset" and replace with --as set--.

Signed and Sealed this
Eighteenth Day of October, 2011

David J. Kappos

David J. Kappos
*Director of the United States Patent and Trademark Office*